US008327836B2

(12) United States Patent
Brown et al.

(10) Patent No.: US 8,327,836 B2
(45) Date of Patent: Dec. 11, 2012

(54) BICENTRIC DIRECT VENT TERMINAL

(75) Inventors: Michael L. Brown, Greenwood, IN (US); Gary E. Georgette, Avon, IN (US)

(73) Assignee: Carrier Corporation, Farmington, CT (US)

( * ) Notice: Subject to any disclaimer, the term of this patent is extended or adjusted under 35 U.S.C. 154(b) by 453 days.

(21) Appl. No.: 12/520,124

(22) PCT Filed: Dec. 21, 2006

(86) PCT No.: PCT/US2006/048808

§ 371 (c)(1),
(2), (4) Date: Jun. 19, 2009

(87) PCT Pub. No.: WO2008/076116

PCT Pub. Date: Jun. 26, 2008

(65) Prior Publication Data

US 2010/0089382 A1 Apr. 15, 2010

(51) Int. Cl.
*F23L 17/04* (2006.01)

(52) U.S. Cl. ..... 126/307 A; 126/312; 126/85 B; 454/8

(58) Field of Classification Search ..... 126/85 B, 126/307 A, 312; 454/8; 98/62
See application file for complete search history.

(56) References Cited

U.S. PATENT DOCUMENTS

| | | | | |
|---|---|---|---|---|
| 3,040,734 | A * | 6/1962 | Field et al. | 126/307 R |
| 3,052,230 | A * | 9/1962 | Conrad | 126/307 R |
| 3,428,040 | A | 2/1969 | Baker et al. | |
| 3,552,377 | A | 1/1971 | Hodges | |
| 3,643,646 | A | 2/1972 | Honaker, Jr. | |
| 3,994,280 | A | 11/1976 | Winters et al. | |
| 4,111,004 | A | 9/1978 | Blomberg | |
| 4,262,608 | A | 4/1981 | Jackson | |
| 4,690,129 | A | 9/1987 | Halstead | |
| 4,995,375 | A | 2/1991 | Jackson | |
| D320,650 | S | 10/1991 | Kujawa et al. | |
| 5,062,354 | A * | 11/1991 | Goins et al. | 454/237 |
| 5,282,456 | A | 2/1994 | Smelcer et al. | |
| 5,762,062 | A | 6/1998 | Hawkinson et al. | |
| 6,039,041 | A | 3/2000 | Barth | |
| 6,044,835 | A | 4/2000 | Brown et al. | |
| 6,053,162 | A | 4/2000 | Godfree et al. | |
| 6,102,030 | A * | 8/2000 | Brown et al. | 126/85 B |
| 6,125,839 | A | 10/2000 | Elgowainy et al. | |
| 6,289,886 | B1 | 9/2001 | Radke | |
| 6,543,438 | B1 | 4/2003 | Roetken et al. | |
| 6,647,977 | B2 | 11/2003 | Lesage | |
| 6,776,704 | B2 | 8/2004 | Goncalves et al. | |

FOREIGN PATENT DOCUMENTS

| | | | |
|---|---|---|---|
| EP | 1039222 | A1 | 9/2000 |
| EP | 1041342 | A1 | 10/2000 |
| JP | 5720471 8 | A * | 12/1982 |

OTHER PUBLICATIONS

International Search Report and Written Opinion mailed Nov. 1, 2007 (7 pgs.).

* cited by examiner

*Primary Examiner* — Alfred Basichas
(74) *Attorney, Agent, or Firm* — Cantor Colburn LLP

(57) ABSTRACT

A combined air intake and combustion gas vent terminal is provided for engagement with at least one of a pair of pipes extending horizontally and being spaced apart to accommodate the inward flow of combustion air and the outwardly flow of exhaust air from a furnace. The terminal assembly is installed entirely outside of the building and has a stepped structure for engaging the pipes such that it can accommodate different sized pipes.

10 Claims, 4 Drawing Sheets

BICENTRIC DIRECT VENT TERMINAL

FIELD OF THE INVENTION

This invention relates generally to furnaces and, more particularly, to a horizontal combined air intake and combustion gas vent terminal assembly.

BACKGROUND OF THE INVENTION

Combined air intake and combustion gas vent terminals, sometimes referred to as vent/intake terminals, have long been used with fuel fired heating appliances, particularly with side wall vented gas fireplaces and furnaces. Combined vent/intake terminals typically comprise concentrically mounted vent and intake conduits, with a large intake conduit disposed around a smaller vent conduit. The terminal is installed in an exterior wall of a building, with the intake and vent opening exterior to the building. The recent popularity of the side wall vented furnaces, also known as horizontally vented or direct vented furnaces is due to the ease with which the required air intake and the flue systems may be installed in the building. Correspondingly, there has been an increased demand for vent/intake terminals because such devices simplify installation effort and cost, as only a single fixture need be installed.

One problem commonly encountered with vent/intake terminals is an unwanted recirculation of combustion gases into the terminal intake which reduces the efficiency of combustion in the fuel fired appliance. Such recirculation is principally caused by the close proximity of the intake and vent openings, and one approach to solving this is the use of an anti-mixing baffle to isolate the two.

Another problem that can occur with such systems is that of wind induced pressure effects on the operation of the terminal. That is, the different orientations of the intake and vent openings in the prior art terminals may result in wind induced pressure differentials between the openings. This is undesirable because it modifies the pressure differential generated by the appliance between the intake and vent openings. The combustion pressure differential, which causes intake air to be induced into the appliance and combustion gas to be expelled therefrom, is carefully balanced in high efficiency furnaces to permit an efficient combustion of fuel in the appliance.

To complicate matters, the preferred combustion pressure differential varies with the type of system involved. For example, with oil fired furnaces, referred to as positive pressure furnaces, it is relatively small as compared with that of a draft induced furnace, wherein the speed and pressure at which the draft inducer fan operates reduces the sensitivity of the vent/intake system to wind induced pressure and balance across the intake and vent outlet.

Another problem which can occur with concentric vent/intake terminals is that of over-cooling of the exhaust gas. That is, during conditions of prolonged extreme cold weather, the air intake pipe can cool the exhaust gas to an extent that frost can build up on the inner wall of the exhaust pipe near the outlet, eventually shutting down the furnace.

Another problem that the applicants have encountered with the prior art vent/intake terminals is that they may be of too great a length for a particular installation. That is, when the vent pipes run perpendicular to the floor joists, which are typically spaced 16 inches apart, then the vent/intake terminal cannot be installed if it is substantially greater than 16 inches in length.

What is needed is a vent/intake terminal that overcomes these problems and is easy to install and effective in use.

SUMMARY OF THE INVENTION

In accordance with one aspect of the invention, the vent and intake terminals are separated and placed in side-by-side relationship rather than in a concentric relationship.

In accordance with another aspect of the invention, the two pipes leading to and from the furnace extend through the wall to the outside, and the entire terminal assembly is disposed outside.

In accordance with another aspect of the invention, a stepped structure may be provided on the inner diameters of the vent/intake terminals so as to thereby accommodate different size pipes.

In the drawings as hereinafter described, a preferred embodiment and modified embodiments are depicted; however, various other modifications and alternate constructions can be made thereto without departing from the spirit and scope of the invention.

DESCRIPTION OF THE PREFERRED EMBODIMENT

Figure 1:
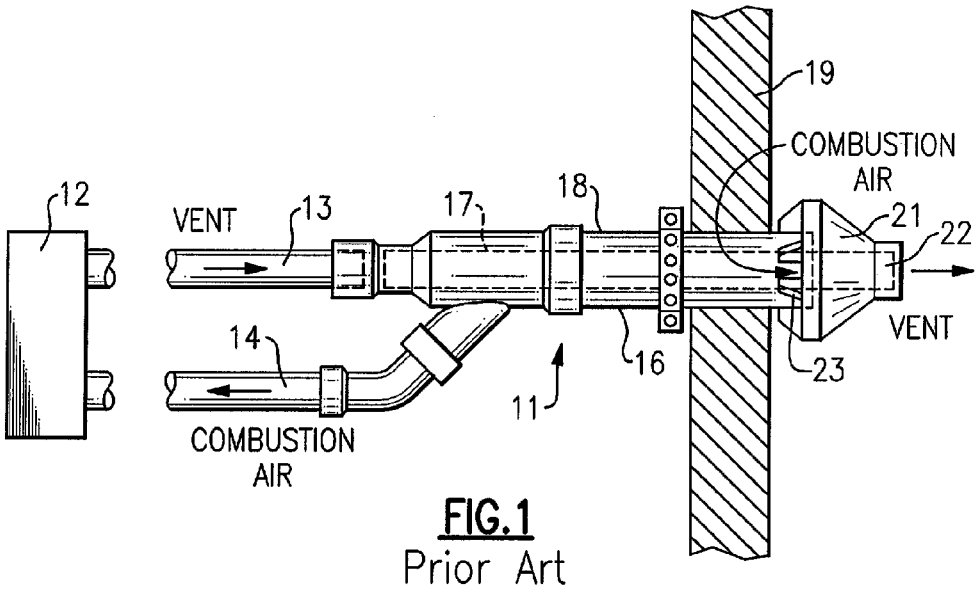
FIG.1 Prior Art
FIG. 1 is a schematic illustration of a vent/intake terminal in accordance with the prior art.

Referring to FIG. 1, there is shown a vent/intake terminal assembly as installed in a building for use with a furnace 12 in accordance with the prior art. The vent exhaust pipe 13 is fluidly connected to the furnace 12 for the purpose of conducting the flow of combustion products outside of the building. Similarly, a combustion air pipe 14 is fluidly interconnected to the furnace for the purpose of conducting the flow of outside air to the furnace for use in the combustion process.

As part of the assembly, a coaxial pipe 16 is connected to both the vent exhaust pipe 13 and the combustion air pipe 14 as shown, with the vent exhaust pipe 13 fluidly communicating with the ambient air by way of an inner pipe 17, and the combustion air pipe fluidly communicating with ambient by way of an outer pipe 18. The coaxial pipe 16 passes through the building outer wall 19 and extends outwardly thereof as shown. A vent cap 21 is disposed on the end of the coaxial pipe 16 and acts to physically separate the inflow of fresh air from the outflow of combustion gases. That is, the combustion gases are discharged out the terminal end 22 while the ambient air flows in through the stand-offs 23 and is then routed into the concentric channel formed between the inner pipe 17 and the outer pipe 18.

As mentioned hereinabove, one problem with the present approach is that the exhaust gases can be over-cooled by the heat exchange relationship with the inflow of fresh air, such that the frost can build up on the inner wall of the exhaust pipe near the outlet, thereby shutting down the furnace. Another problem associated with this design is the relatively large length of the assembly which includes the coaxial pipe 16.

This overall length can be a problem in certain types of installations such as those in which the joists extend transversely to the direction of the assembly.

Figure 2:
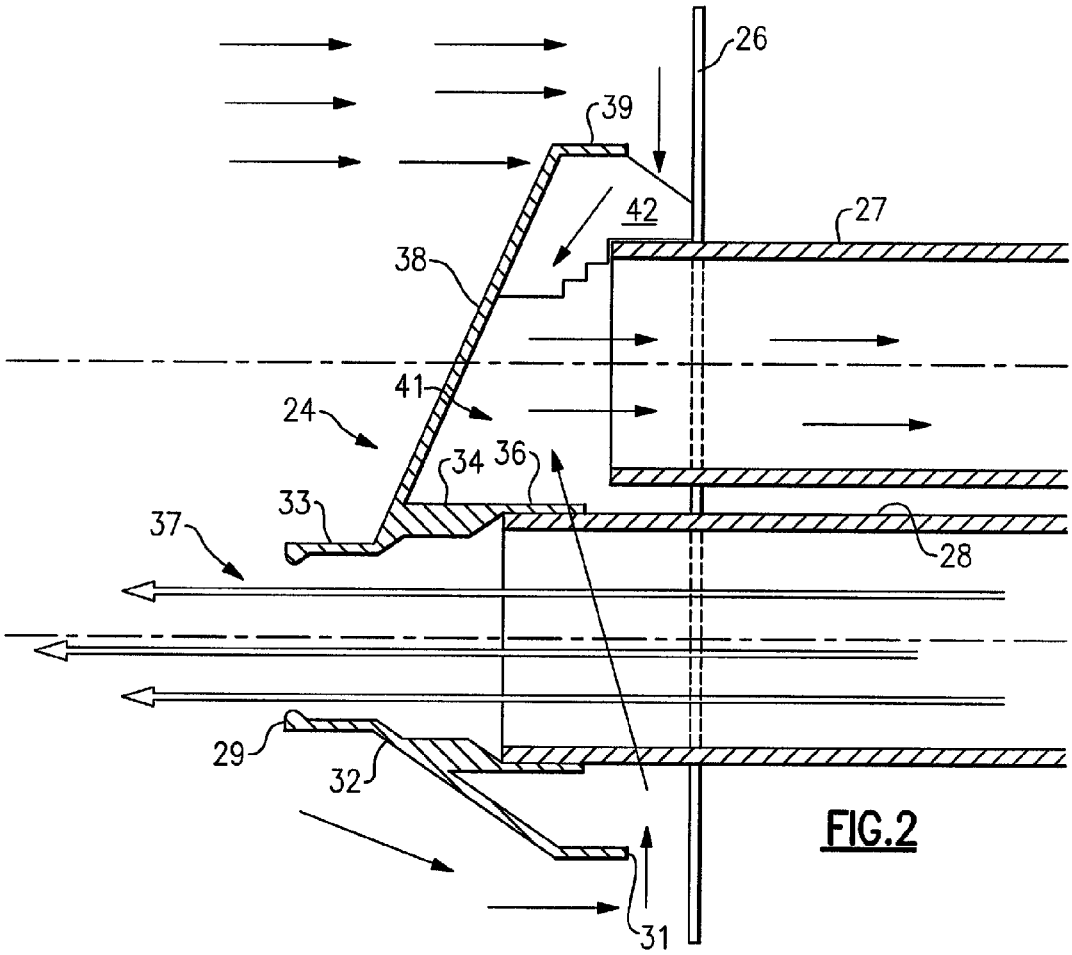
FIG. 2 is a schematic illustration of a vent/intake terminal in accordance with one embodiment of the invention.
Figure 3:
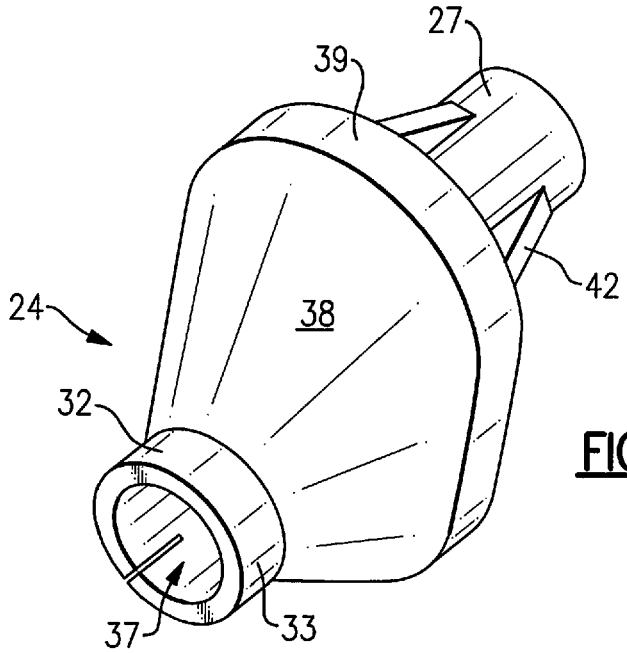
FIG. 3 is a front perspective view thereof.

Referring now to FIGS. 2 and 3, a vent/intake terminal is shown at 24 in accordance with an embodiment of the present invention. The terminal assembly 24 is installed on the outer side of a house wall 26 having a combustion air pipe 27 and a vent exhaust pipe 28 extending therethrough as shown. The centerline to centerline spacing is preferably about four inches and the pipes 27 and 28 are standard 3 inch pipes.

The terminal assembly 24 is a unitary member having an outer end 29 extending away from the wall 26 and an inner end 31 spaced from the wall 26 as shown. Associated with the outer end 29 is a discharge structure 32 which is cylindrical in form and comprised of three serially connected portions 33, 34 and 36 that define an opening 37 therethrough. The portion 33 is of the smallest diameter and is associated with the outer end 29. The portion 34 is of a large diameter and the portion 36 is the greatest diameter and is sized such that its inner diameter allows a close fitting over the vent exhaust pipe 28 as shown. This arrangement allows for the discharge of exhaust gases from the vent exhaust pipe 28 through the discharge structure 32 as shown by the bold arrows.

Connected to the discharge structure 32, at a point between portions 33 and 34, is a wall 38 which extends at an oblique angle toward the inner end 31. Near the inner end of the wall 38 is an integrally connected axially extending portion 39 which terminates at the inner end 31. The wall 38 and the axially extending portion 39, together with the portions 34, 36 and the outer surface of the vent exhaust pipe 28 define an internal space 41 for the flow of ambient air therethrough and into the combustion air pipe 27 as shown by the lighter weight arrows. A standoff structure 42 may be provided to interconnect the wall 38 and a surface of the combustion air pipe 27 as shown. This structure may or may not be in direct contact with the house wall 26. As will be seen, the standoff structure 42 allows for the flow of ambient air around that structure and into the internal space 41.

It should be recognized that the two pipes 27 and 28 are necessarily spaced and may be spaced either vertically or horizontally.

Figure 4:
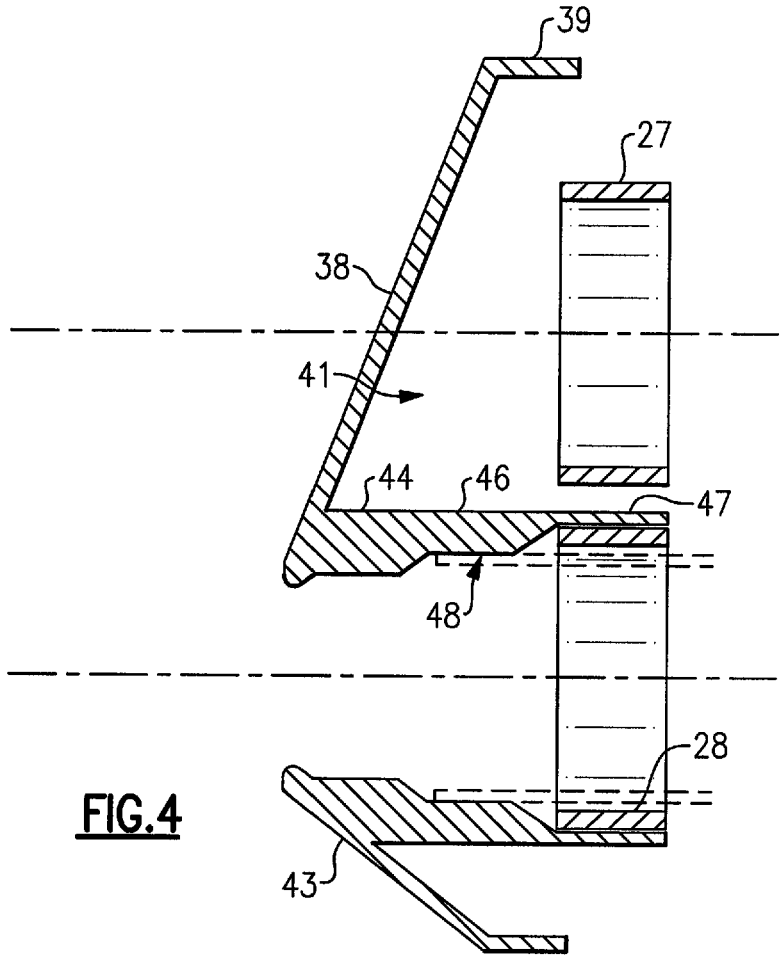
FIG. 4 is an alternative embodiment thereof.

A modified embodiment of the present invention is shown in FIG. 4 wherein the discharge structure 43 does not include an outwardly extending portion but rather has three inwardly extending portions 44, 46 and 47. Its internal diameter is stepped to accommodate the possible use of different sized vent exhaust pipes 28. That is, the assembly may be installed with the portion 47 engaging the outer diameter of the vent exhaust pipe 28 as shown or, the smaller and longer extending vent exhaust pipe may be made to engage the inner surface 48 of the portion 46 as shown by the dotted lines.

It will also be seen in the FIG. 4 embodiment that there is no standoff installed in the axially extending portion 39. That is, the entire assembly is installed on, and supported by, the vent exhaust pipe 28.

Figure 5:
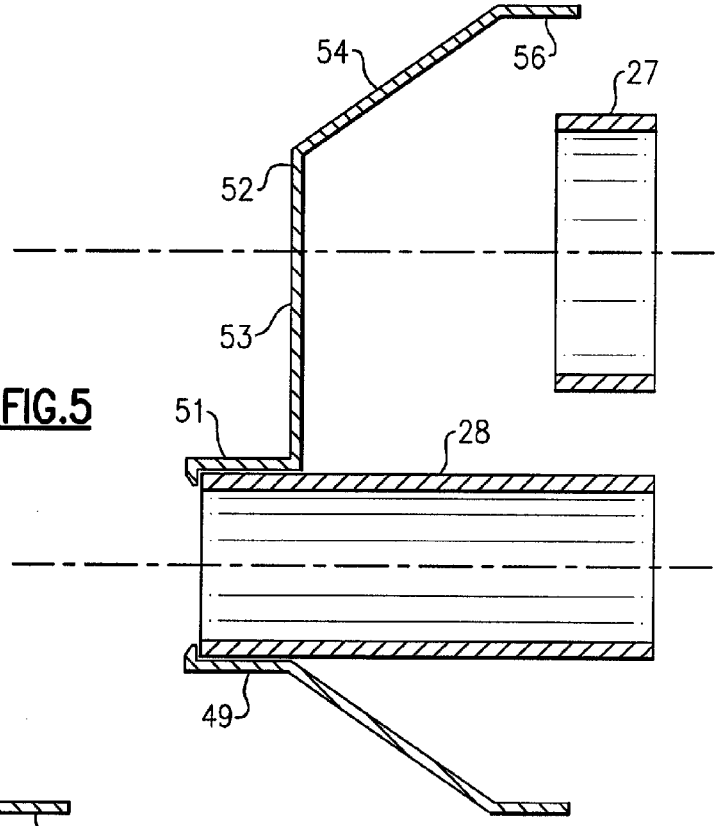
FIG. 5 is another alternative embodiment thereof.

Another embodiment is shown in FIG. 5 wherein a discharge structure 49 includes only an outwardly extending cylindrical portion 51 as shown, with the vent exhaust pipe 28 engaging the inner diameter thereof. Further, the wall 52 includes a radially extending portion 53, an obliquely extending portion 54 and an axially extending portion 56. Again, no standoffs structure is provided, and the entire assembly is again supported by the vent exhaust pipe 28.

Figure 6:
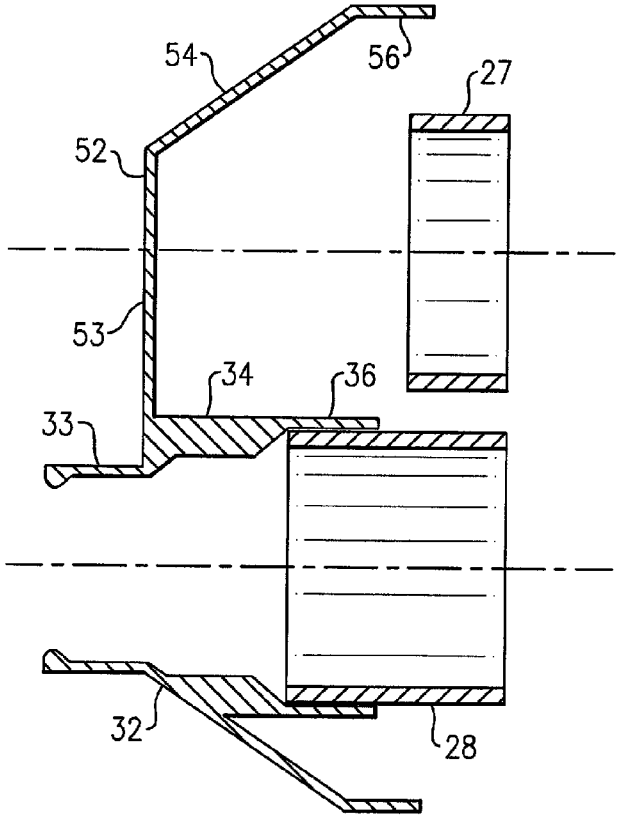
FIG. 6 is a further alternative embodiment thereof.
Figure 7A:
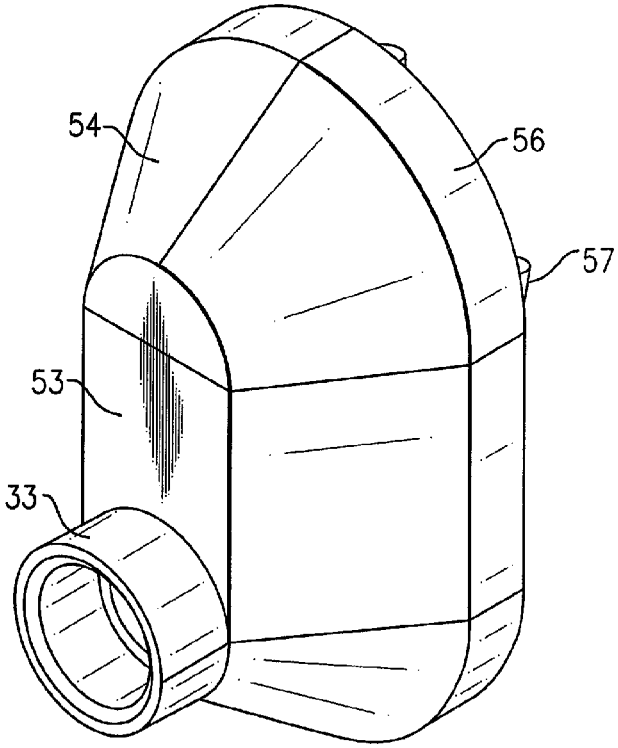
FIGS. 7A and 7B are front and rear perspective views thereof.
Figure 7B:
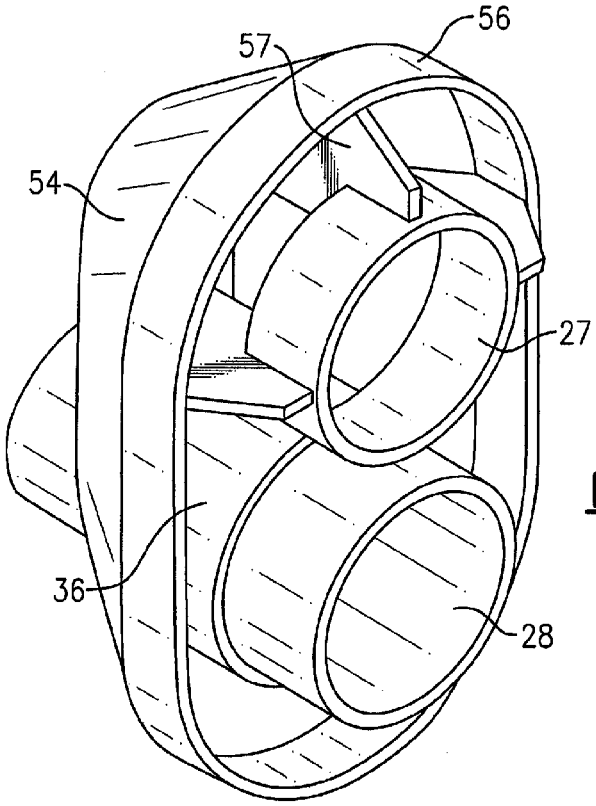

The FIG. 6 embodiment has a discharge structure 32 identical to that as shown in FIG. 2 but the wall 52 is identical to that of the FIG. 5 embodiment and includes the radially extending portion 53, the obliquely extending portion 54 and the axially extending portion 56. FIGS. 7A and 7B are respective front and rear perspective views thereof, with a standoff structure 57 being included.

As will be seen, each of the above designs are for a unitary vent structure that is installed entirely outside of the building, is attached and supported by one or more pipes extending outwardly from the building and allows for the independent discharge of combustion gases and the inflow of combustion air through parallel pipes extending from the house. Because of its outside disposition, it can accommodate any internal structure of a home without installation problems, and because of the parallel relationship, the exhaust gases remain uncooled until they leave the terminal.

We claim:

1. A combined air intake and combustion gas vent terminal for registration with a pair of spaced pipes extending outwardly through a wall of a building comprising:

a terminal assembly having an outer end and an inner end, said outer end having an opening formed therein, with said opening being defined by a discharge structure that engagingly registers with one of said pair of spaced pipes; and a wall attached to said discharge structure and extending generally radially outwardly therefrom and terminating at said inner end, said wall defining an internal space which fluidly interconnects an opening in the other of said pair of spaced pipes with ambient air which flows inwardly around said inner end;

wherein said gas vent terminal is entirely installed on, and supported by, said one of said pair of spaced pipes.

2. A gas vent terminal as set forth in claim 1 wherein said pair of spaced pipes are vertically spaced.

3. A gas vent terminal as set forth in claim 1 wherein said pair of spaced pipes are horizontally spaced.

4. A gas vent terminal as set forth in claim 1 wherein said discharge end opening is cylindrical in form with a horizontally extending axis.

5. A gas vent terminal as set forth in claim 1 wherein said discharge structure is cylindrical in form with its axis horizontally aligned.

6. A gas vent terminal as set forth in claim 1 wherein at least a portion of said wall comprises an obliquely extending portion.

7. A gas vent terminal as set forth in claim 1 wherein said spaced pipes extend through the wall and wherein said gas vent terminal assembly is disposed entirely outside of said wall.

8. A gas vent terminal as set forth in claim 1 wherein said discharge structure is stepped so as to accommodate different sized pipes.

9. A gas vent terminal as set forth in claim 1 wherein the terminal assembly is unitary in structure and composed of a plastic material.

10. A gas vent terminal as set forth in claim 1 wherein said pair of spaced pipes are spaced at a distance of about four inches between centerlines.

* * * * *